US006143104A

United States Patent [19]

Blomquist

[11] Patent Number: 6,143,104

[45] Date of Patent: Nov. 7, 2000

[54] COOL BURNING GAS GENERATING COMPOSITION

[75] Inventor: Harold R. Blomquist, Gilbert, Ariz.

[73] Assignee: TRW Inc., Lyndhurst, Ohio

[21] Appl. No.: 09/026,980

[22] Filed: Feb. 20, 1998

[51] Int. Cl.[7] ..... C06B 31/02

[52] U.S. Cl. ..... 149/61; 149/36; 149/62; 149/45

[58] Field of Search ..... 149/46, 47, 36, 149/45, 19.4, 19.5, 19.9, 61, 62

[56] References Cited

U.S. PATENT DOCUMENTS

| | | | |
|---|---|---|---|
| 3,715,131 | 2/1973 | Hurley et al. | 280/736 |
| 3,912,562 | 10/1975 | Garner | 149/41 |
| 3,954,528 | 5/1976 | Chang et al. | 149/19.4 |
| 3,993,514 | 11/1976 | Pacanowsky et al. | 149/19.5 |
| 4,111,728 | 9/1978 | Ramnarace | 149/19.5 |
| 4,376,001 | 3/1983 | Krone et al. | 149/19.9 |
| 4,948,439 | 8/1990 | Poole et al. . | |
| 4,971,640 | 11/1990 | Chi | 149/19.9 |
| 5,035,757 | 7/1991 | Poole . | |
| 5,098,683 | 3/1992 | Mehrotra et al. | 423/266 |
| 5,139,588 | 8/1992 | Poole . | |
| 5,386,775 | 2/1995 | Poole et al. . | |
| 5,529,647 | 6/1996 | Taylor et al. | 149/2 |
| 5,531,941 | 7/1996 | Poole | 264/3.4 |
| 5,557,062 | 9/1996 | MacLaren et al. | 149/46 |
| 5,589,661 | 12/1996 | Menke et al. | 149/19.4 |
| 5,596,168 | 1/1997 | Menke et al. | 149/19.4 |
| 5,847,315 | 12/1998 | Katzakian et al. | 149/46 |
| 5,866,842 | 2/1999 | Wilson et al. | 149/46 |
| 5,872,329 | 2/1999 | Burns et al. | 149/36 |

FOREIGN PATENT DOCUMENTS

| | | |
|---|---|---|
| 0661253 | 7/1995 | European Pat. Off. . |
| 9519944 | 7/1995 | WIPO . |
| 9822208 | 5/1998 | WIPO . |

*Primary Examiner*—Edward A. Miller
*Attorney, Agent, or Firm*—Tarolli, Sundheim, Covell, Tummino & Szabo L.L.P.

[57] ABSTRACT

A gas generating composition comprises an organic fuel and an oxidizer wherein a component of the composition comprises an alkaline earth metal or alkali metal ion. The composition also comprises an ammonium salt coolant selected from the group consisting of ammonium halide, ammonium sulfate, and ammonium sulfamate. A preferred coolant is ammonium chloride. The anion of the ammonium salt on combustion of the gas generating composition reacts with the alkaline earth metal or alkali metal ion to produce a high melting point salt. The amount of coolant is an effective amount to obtain a reaction product which is substantially free of alkaline earth metal or alkali metal oxide. In the combustion reaction, the ammonium salt coolant reacts endothermically with other components of the reaction mixture reducing the combustion temperature of the reaction mixture.

8 Claims, No Drawings

COOL BURNING GAS GENERATING COMPOSITION

FIELD OF THE INVENTION

The present invention relates to a gas generating composition. The present invention is particularly useful for generating gas to inflate an inflatable vehicle occupant protection device.

BACKGROUND OF THE INVENTION

Azide-based gas generating compositions for generating gas to inflate an inflatable vehicle occupant protection device have the advantage that they produce non-toxic nitrogen gas during combustion and produce gas at relatively low gas temperatures, in the range of 1100° to 1500° K.

Non-azide based gas generating compositions, in contrast, typically produce gas at temperatures well above the cool-burning azide systems, typically in the range of 2000° to 2500° K, with some approaching 4000° K. While these hot burning systems potentially are thermodynamically efficient, they present heat management problems.

For instance, it may be necessary, because of the high temperatures, to manufacture certain components of the vehicle occupant protection device of more expensive materials that are resistant to the high temperature gas which is generated. In addition, the non-azide based gas generating compositions tend to produce reaction products which may be in a liquid phase at the high temperature and thus may be more difficult to filter.

Various attempts to cool non-azide based gas generating compositions are described in the patent literature. For instance, it has been proposed to add chemical coolants to the compositions. Chemical coolants, however, tend to add to the volume of the gas generating material required without increasing the gas output. This reduces the gas output per volume of gas generating material in an amount dependent upon the amount of coolant added.

Mechanical approaches to cooling the products of combustion of gas generating compositions involve using filters which function as both a heat exchanger and a particulate trap. However, the gas volume output tends to drop dependent upon the heat loss to the filter, especially if the particulate trapping in the filter is highly efficient.

SUMMARY OF THE INVENTION

The present invention resides in a gas generating composition which comprises an organic fuel and an oxidizer wherein a component of the composition comprises an alkali metal or an alkaline earth metal ion. The composition further comprises an ammonium salt coolant selected from the group consisting of an ammonium halide, ammonium sulfate, and ammonium sulfamate. A preferred ammonium salt is ammonium chloride ($NH_4Cl$). The amount of ammonium salt present in the gas generating composition is an amount effective, on combustion, to produce a reaction product which comprises the anion of the ammonium salt reacted with the alkali metal or alkaline earth metal ion. The reaction product preferably is substantially free of alkali metal or alkaline earth metal oxide. The ammonium salt reacts with other components of the reaction mixture in an endothermic reaction which reduces the combustion temperature of the reaction mixture.

Preferably, the gas generating composition of the present invention also comprises a low temperature sinter-forming material which is present in the composition in an amount effective to cause liquid particles of the reaction product to coalesce during combustion into an easily filterable slag. Preferred sinter-forming materials are silicon dioxide ($SiO_2$) and aluminum oxide ($Al_2O_3$).

In an embodiment of the present invention, the oxidizer is an alkali metal or alkaline earth metal salt, and the mol ratio of oxidizer to ammonium salt in the gas generating composition is about 1:1 for substantially complete reaction of the anion of the ammonium salt with the metal ion of the oxidizer. Preferably, the gas generating composition is balanced for substantially complete reaction of carbon with oxygen in the gas generating composition to produce carbon dioxide.

The present invention also resides in an inflatable vehicle occupant protection device which comprises an inflator for generating gas to inflate the protection device using the foregoing gas generating composition.

DESCRIPTION OF PREFERRED EMBODIMENTS

For purposes of the present application, all percents are given as weight percents based on the total composition weight, unless otherwise specified.

Also, for purposes of the present application, the term "organic fuel" includes salts of organic fuels.

The gas generating composition of the present invention comprises a non-azide organic fuel, which can be any non-azide organic fuel typically used in a gas generating composition. Examples of useful organic fuels in the present invention are: cyanamides such as dicyandiamide and salts thereof; tetrazoles such as 5-amino-tetrazole (5-AT), and derivatives and salts of tetrazoles; carbonamides such as azo-bis-dicarbonamide and salts thereof; triazoles such as 3-nitro-1,2,4-triazole-5-one (NTO) and salts thereof; guanidine and derivatives thereof such as nitroguanidine; salts of guanidine and guanidine derivatives such as triaminoguanidine nitrate (TAGN) or guanidine nitrate (GN); tetramethyl ammonium nitrate; urea and urea salts; triazines and tetrazines such as trinitro-1,3,5-triazine (RDX), and octahydro-1,3,5,7-tetranitro-1,3,5,7-tetrazine (HMX); and combinations of such fuels.

The amount of fuel in the gas generating composition is that amount necessary to achieve sustained combustion of the gas generating composition. The amount can vary widely depending upon the particular fuel involved and other reactants. A preferred amount is within the range from about 8% to about 40% based on the weight of the gas generating composition.

The gas generating composition of the present invention also comprises an oxidizer. Any oxidizer conventionally used in a gas generating composition can be used in the present invention. Useful oxidizers include: nitrates such as alkali metal and alkaline earth metal nitrates; perchlorates such as alkali metal and alkaline earth metal perchlorates; nitrites such as alkali metal and alkaline earth metal nitrites; dinitramides, and mixtures thereof. Good results are achieved with an alkali metal or alkaline earth metal nitrate. Advantages can be achieved when the nitrate is strontium nitrate.

The amount of oxidizer is that amount necessary to achieve sustained combustion with the fuel. A preferred amount is in the range of about 35 to about 75% based upon the weight of the gas generating composition.

A critical component of the gas generating composition of the present invention is an ammonium salt selected from the group consisting of an ammonium halide, an ammonium sulfate, and an ammonium sulfamate. A preferred ammonium salt is ammonium chloride ($NH_4Cl$).

The amount of ammonium salt in the gas generating composition is preferably that amount which provides approximately a 1:1 mol ratio with the oxidizer. This results in substantially complete reaction of the anion of the ammonium salt with the metal ion of the oxidizer to produce, on combustion, a reaction product which comprises the anion of the ammonium salt reacted with the alkali metal or alkaline earth metal ion and which is substantially free of metal oxide. The amount of ammonium salt preferably is in the range of about 5% to about 40%.

In the present invention, the ammonium salt reacts with other components of the reaction mixture in an endothermic reaction which reduces the combustion temperature of the reaction mixture. It was found that when the ammonium salt is present in the gas generating composition in a mol ratio with the oxidizer which is approximately 1:1, it provides a surprising reduction in the adiabatic flame temperature of the reaction product. Temperature reductions of 400° K (Kelvin) to 600° K or more are possible.

The present invention also preferably comprises a sinter-forming material which forms a solid sinter at the combustion temperature of the reaction product. Preferred sinter-forming materials are aluminum oxide ($Al_2O_3$) and silicon dioxide ($SiO_2$). The amount of sinter-forming material is that amount effective to coalesce liquid components in the reaction product into an easily filterable slag. A preferred amount of sinter-forming material is in the range of about 0 to about 10%, preferably in the range of about 4 to about 8%, based on the weight of the gas generating composition.

Preferably the components of the gas generating composition are present in a ratio adjusted to provide a reaction product which is substantially free of carbon monoxide; that is, wherein the carbon in the reaction mixture is substantially or completely oxidized to carbon dioxide.

The present invention can comprise other ingredients commonly added for a properly functioning system, such as opacifiers, process aids, binders, and ignition aids.

EXAMPLES 1–18

The following Examples illustrate the present invention.

In Examples 1 to 6, dicyandiamide is the fuel component. The formulations and combustion results for Examples 1 to 6 are given in Table 1.

In Examples 7 to 12, the fuel is 5-amino-tetrazole (5-AT). The formulations and combustion results for Examples 7 to 12 are given in Table 2.

In Examples 13 to 18, the fuel is nitroguanidine (NQ). The formulations and combustion results for Examples 13 to 18 are given in Table 3.

All of the combustion results for Tables 1, 2 and 3 are calculated. All of the formulations are based on a 1:1 mol ratio of ammonium salt to oxidizer, and an oxygen balance which produces carbon dioxide as a product, rather than carbon monoxide.

The term "Sp Impulse" in the Tables is a parameter indicating the amount of energy released during combustion of the gas generating composition based on unit mass of gas generating material. The units are pounds force seconds/pounds mass.

TABLE 1

FORMULATIONS BASED ON DICYANDIAMIDE FUEL

| | EX 1 | EX 2 | EX 3 | EX 4 | EX 5 | EX 6 |
|---|---|---|---|---|---|---|
| Formulations | | | | | | |
| Dicyandiamide | 29.2 | 9.2 | 10.7 | 12.2 | 12.0 | 14.8 |
| Ammonium chloride | 0 | 35.1 | 30.4 | 25.7 | 28.1 | 21.1 |
| Sodium nitrate | 70.8 | 55.7 | 54.9 | 54.1 | 55.9 | 56.1 |
| Aluminum oxide | 0 | 0 | 4 | 8 | 0 | 0 |
| Silicon oxide | 0 | 0 | 0 | 0 | 4 | 8 |
| Performance Criteria | | | | | | |
| T chamber, K | 2325 | 1663 | 1685 | 1708 | 1754 | 1844 |
| Exhaust moles gas/100 g | 2.11 | 2.63 | 2.5 | 2.39 | 2.50 | 2.40 |
| Gas mole weight | 39.7 | 30.5 | 31.7 | 33.0 | 32.4 | 34.5 |
| Sp impulse | 184.7 | 164 | 162 | 160 | 166 | 167 |
| Exhaust Composition, major components, calculated moles per 100 grams | | | | | | |
| Water | .677 | 1.53 | 1.39 | 1.25 | 1.33 | 1.14 |
| Nitrogen | 1.11 | .87 | .86 | .85 | .88 | .88 |
| Carbon dioxide | .29 | .22 | .25 | .29 | .29 | .35 |
| Sodium chloride | .40 (carbonate) | .66 | .57 | .48 | .52 | .38 |
| Sodium aluminate | 0 | 0 | .08 | .16 | 0 | 0 |
| Sodium silicate | 0 | 0 | 0 | 0 | .07 | .133 |

TABLE 2

FORMULATIONS BASED ON 5-AMINO-TETRAZOLE FUEL

| | EX 7 | EX 8 | EX 9 | EX 10 | EX 11 | EX 12 |
|---|---|---|---|---|---|---|
| Formulations | | | | | | |
| 5-amino-tetrazole | 41.7 | 14.9 | 17.4 | 19.9 | 19.5 | 24.1 |
| Ammonium chloride | 0 | 32.9 | 27.8 | 22.7 | 25.2 | 17.5 |
| Sodium nitrate | 58.3 | 52.2 | 50.8 | 49.4 | 51.3 | 50.4 |
| Aluminum oxide | 0 | 0 | 4 | 8 | 0 | 0 |
| Silicon oxide | 0 | 0 | 0 | 0 | 4 | 8 |
| Performance Criteria | | | | | | |
| T chamber, k | 2394 | 1791 | 1838 | 1881 | 1917 | 2031 |
| Exhaust moles gas/100 g | 2.5 | 2.7 | 2.6 | 2.5 | 2.7 | 2.5 |
| Gas mole weight | 35.5 | 30.0 | 31.1 | 32.3 | 31.7 | 33.4 |
| Sp impulse | 200 | 173 | 173 | 172 | 177 | 180 |
| Exhaust Composition, major components, calculated moles per 100 grams | | | | | | |
| Water | .71 | 1.49 | 1.34 | 1.20 | 1.28 | 1.08 |
| Nitrogen | 1.57 | 1.05 | 1.07 | 1.09 | 1.11 | 1.17 |
| Carbon dioxide | .17 | .17 | .20 | .23 | .29 | .28 |
| Sodium chloride | .32 (carbonate) | .61 | .52 | .42 | .45 | .33 |
| Sodium aluminate | 0 | 0 | .078 | .16 | 0 | 0 |
| Sodium silicate | 0 | 0 | 0 | 0 | .07 | .13 |

TABLE 3

FORMULATIONS BASED ON NITROGUANIDINE FUEL

| | EX 13 | EX 14 | EX 15 | EX 16 | EX 17 | EX 18 |
|---|---|---|---|---|---|---|
| Formulations | | | | | | |
| Nitroguanidine | 60.5 | 27.3 | 31.8 | 36.3 | 35.7 | 44.1 |
| Ammonium chloride | 0 | 28.1 | 22.2 | 16.3 | 18.9 | 9.8 |
| Sodium nitrate | 39,5 | 44.6 | 42.0 | 39.3 | 41.4 | 38.1 |
| Aluminum oxide | 0 | 0 | 4 | 8 | 0 | 0 |
| Silicon oxide | 0 | 0 | 0 | 0 | 4 | 8 |
| Performance Criteria | | | | | | |
| T chamber, k | 2371 | 1918 | 1974 | 2029 | 2055 | 2189 |
| Exhaust moles gas/100 g | 2.9 | 2.9 | 2.8 | 2.8 | 2.8 | 2.8 |
| Gas mole weight | 31.8 | 29.3 | 30.2 | 31.3 | 30.6 | 32.1 |
| Sp impulse | 211 | 184 | 185 | 186 | 190 | 196 |
| Exhaust Composition, major components, calculated moles per 100 grams | | | | | | |
| Water | 1.15 | 1.57 | 1.44 | 1.30 | 1.39 | 1.21 |
| Nitrogen | 1.39 | 1.05 | 1.06 | 1.08 | 1.11 | 1.16 |
| Carbon dioxide | .36 | .26 | .31 | .35 | .34 | .42 |
| Sodium chloride | .22 (carbonate) | .53 | .41 | .28 | .35 | .18 |
| Sodium aluminate | 0 | 0 | .08 | .16 | 0 | 0 |
| Sodium silicate | 0 | 0 | 0 | 0 | .07 | .13 |

Referring to Table 1, Example 1 is an uncooled formulation containing no ammonium salt such as ammonium chloride. Combustion of the gas generating composition of Example 1 yields a chamber temperature of about 2325° K. The reaction also produces 0.4 moles of sodium carbonate which is a liquid at the reaction products temperature.

Example 2 is a cooled formulation which contains 35.1% ammonium chloride. The amount of ammonium chloride is adjusted to a 1:1 mol ratio with the oxidizer, sodium nitrate, to produce 0.66 moles of sodium chloride as a reaction product. The reaction product is substantially free of sodium oxide. Sodium chloride has a higher melting point than sodium oxide. The reaction of ammonium chloride with sodium nitrate is endothermic. The called-for amount of ammonium chloride yields a reaction product which has a chamber temperature of only 1663° K, much lower than the chamber temperature in Example 1. Sodium chloride is filterable at the lower temperature of 1663° K. The mol ratio of fuel (dicyandiamide) to oxidizer (sodium nitrate) is adjusted for complete oxidation of carbon atoms in the fuel to carbon dioxide.

Examples 3 and 4 have compositions similar to that of Example 2, but which also contain aluminum oxide ($Al_2O_3$) in the amounts of 4% and 8%, respectively. As with Example 2, the amount of coolant (ammonium chloride) is adjusted so that the chlorine ions of the coolant react with sodium of the oxidizer (sodium nitrate) to produce sodium chloride (rather than sodium oxide). In Example 3, this amount (30.4%) reacts endothermically with other components of the reaction mixture producing a chamber temperature of 1685° K, slightly higher than that of Example 2, but much lower than that of Example 1. The amount of oxidizer (sodium nitrate) is sufficient to provide sodium for reaction with the aluminum oxide to produce a sodium aluminate sinter. Sodium aluminate has a melting point which is above the cooled chamber temperature of 1685° K, and is thus a solid in the combustion chamber. The sodium aluminate solids coalesce the liquid sodium chloride producing a slag which is easily filtered. As with Example 2, the amount of fuel (dicyandiamide) is adjusted for complete oxidation of carbons in the fuel to carbon dioxide.

In Example 4, more aluminum oxide sinter-former is present for even better slagging of the sodium chloride. Otherwise, the results achieved in Example 4, for instance, a chamber temperature of 1708° K, a reaction product comprising sodium chloride and substantially free of sodium oxide, and complete oxidation of carbon atoms in the fuel, are similar to those of Example 3.

In Examples 2, 3, and 4, the exhaust stream which is produced in the combustion reaction has a low toxicity in addition to a significant reduction in adiabatic flame temperature. The major gaseous components of the exhaust stream, in addition to carbon dioxide (the chloride and aluminate being filterable) are water and nitrogen.

In Examples 2, 3, and 4, the amount of gas produced in the combustion reaction, and its energy, are effective for activating a vehicle occupant protection device such as an air bag.

In this respect, it can be noted that the present invention although primarily useful for a vehicle occupant protection device, can have other uses, for instance other types of safety cushions or inflatable devices, fire extinguishers, and other gas generator applications.

Similar results are achieved with Examples 5 and 6 using silicon dioxide as a sinter-former, in the amounts of 4% and 8%, respectively.

Table 2 shows that ammonium chloride is an effective coolant with 5-amino-tetrazole (5-AT) as a fuel component, reducing the chamber temperature from 2394° K (Example 7) to 1791° K (Example 8), when used in the amount of about 32.9%. Examples 9 to 12 show effective slag recovery when the compositions are modified to contain amounts of a sinter-former such as aluminum oxide or silicon dioxide, similar to Examples 3 to 6.

Similar results are obtained with the compositions of Examples 13 to 18 using nitroguanidine as a fuel.

All of the Examples of Tables 1, 2, and 3 use the same oxidizer, sodium nitrate, for purposes of comparison. Another useful oxidizer in the present invention is strontium nitrate. If the oxide MeO forms from decomposition of the oxidizer during the combustion reaction, it is desirable that it be filterable. Strontium oxide (SrO) has a higher melting point than sodium oxide ($Na_2O$), 2065° C. compared to 1132° C. This means that, at the combustion chamber temperature, when cooled by the coolant, whatever strontium oxide is formed, it is more likely to remain in the condensed phase, making it more filterable, particularly if a sinter-former is present in the gas generating composition.

Yet another useful oxidizer in the present invention is ammonium nitrate. Ammonium nitrate is usually phase stabilized with 5 to 15 weight percent (based on the weight of ammonium nitrate) of a stabilizing salt such as potassium nitrate ($KNO_3$). The coolant, for instance, ammonium chloride, is added to the gas generating composition in an amount effective for reaction of the anion of the coolant (chlorine) with the metal ion of the stabilizing salt (e.g, potassium) to form the chloride MeCl (e.g., KCl). As above, the chloride is more likely to remain in the condensed phase during combustion, than the oxide, particularly when the reaction product is cooled by the ammonium chloride, thus making the reaction product more filterable.

In addition, the present invention is useful when the fuel itself is a salt and contains an alkali metal or alkaline earth metal ion, such as potassium bitetrazole. The anion of the coolant (e.g., $NH_4Cl$) in this instance can function to tie up the metal ion of the fuel as well as cool the reaction product. An example of a gas generating composition comprising a salt fuel is one comprising potassium bitetrazole as the fuel, ammonium nitrate as the oxidizer (with or without phase stabilization), and ammonium chloride as the coolant.

Advantages of the present invention should now be apparent. Primarily, the present invention provides an effective means for cooling a reaction mixture which comprises an alkali metal or alkaline earth metal ion. When the amount of coolant used is balanced for substantially complete reaction of the anion of the coolant, for instance, chloride, with the alkali metal or alkaline earth metal ion, there is a substantial and surprising reduction in the adiabatic flame temperature of the reaction mixture. The reaction of the present invention thus results in not only a cooler reaction product, but also a relatively low-toxicity exhaust stream, particularly one which is substantially free of alkali metal or alkaline earth metal oxides and has reduced amounts of nitrogen oxides.

Since the ammonium salt coolant is in effect a fuel component, producing on combustion only gas or vapor phase products, an improved output per unit chamber volume is achieved compared to the use of conventional chemical coolants.

In addition, the present invention is particularly useful with sinter-forming materials since it lowers the temperature of the reaction product a sufficient amount for the sinter-forming materials to be effective as slagging agents for liquid components in the reaction product.

From the above description of the invention, those skilled in the art will perceive improvements, changes and modifications. Such improvements, changes and modifications within the skill of the art are intended to be covered by the appended claims.

Having described the invention, the following is claimed:

1. A gas generating composition suitable for inflating a vehicle occupant protection device comprising:

an organic fuel selected from the group consisting of cyanamides, tetrazoles, carbonamides, triazoles, guanidines, salts of guanidine, tetramethyl ammonium nitrate, triazines, tetrazines, urea, salts of urea, and combinations thereof, an oxidizer selected from the group consisting of an alkali metal nitrate, an alkaline earth metal nitrate, an alkali metal nitrite, an alkaline earth metal nitrite or a combination thereof, and an ammonium halide coolant, wherein the amount of ammonium halide coolant and the amount of oxidizer are balanced for substantially complete reaction of the anion of the coolant with the alkali metal or alkaline earth metal cation of the oxidizer, the reaction product being substantially free of alkali metal or alkaline earth metal oxide.

2. The composition of claim 1 wherein said coolant is ammonium chloride.

3. The composition of claim 1 comprising about 8 to about 40 weight % organic fuel about 35 to about 75 weight % oxidizer, and about 5 to about 40 weight % ammonium salt coolant.

4. The composition of claim 3 further comprising 0 to about 10 weight % of a sinter-forming material.

5. The composition of claim 4 wherein said sinter-forming material is selected from the group consisting of aluminum oxide and silicon dioxide.

6. The composition of claim 1 wherein said oxidizer is an alkali metal nitrate or an alkaline earth metal nitrate.

7. The composition of claim 6 wherein said oxidizer is selected from the group consisting of strontium nitrate, barium nitrate, potassium nitrate, and sodium nitrate.

8. A generating composition suitable for inflating a vehicle occupant protection device comprising:

(a) about 8 to about 40 weight % of an organic fuel selected from the group consisting of cyanamides; tetrazoles; carbonamides; triazoles; guanidines; salts of guanidine; nitroguanidine; tetramethyl ammonium nitrate; triazines; tetrazines; urea; salts of urea; and combinations thereof;

(b) about 35 to about 75 weight % of an oxidizer selected from the group consisting of alkali metal nitrate, alkaline earth metal nitrate, alkali metal nitrite, alkaline earth metal nitrite, and combinations thereof;

(c) about 5 to about 40 weight % of an ammonium chloride coolant; and (d) about 4 to about 8 weight % of a sinter forming material selected from the group consisting of aluminum oxide and silicon oxide;

wherein the amount of coolant and the amount of oxidizer are present in a ratio for substantially complete reaction of the alkali metal or alkaline earth metal cation of the oxidizer with the chloride anion of the coolant to produce, upon combustion, a reaction product substantially free of alkali metal or alkaline earth metal oxides and having reduced amounts of nitrogen oxides.

* * * * *